US010830065B2

(12) United States Patent
Marra

(10) Patent No.: US 10,830,065 B2
(45) Date of Patent: Nov. 10, 2020

(54) ATTACHMENT SYSTEM FOR A TURBINE AIRFOIL USABLE IN A GAS TURBINE ENGINE

(71) Applicant: Siemens Aktiengesellschaft, Munich (DE)

(72) Inventor: John J. Marra, Winter Springs, FL (US)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 140 days.

(21) Appl. No.: 15/571,543

(22) PCT Filed: Jun. 2, 2015

(86) PCT No.: PCT/US2015/033636
§ 371 (c)(1),
(2) Date: Nov. 3, 2017

(87) PCT Pub. No.: WO2016/195656
PCT Pub. Date: Dec. 8, 2016

(65) Prior Publication Data

US 2018/0094529 A1 Apr. 5, 2018

(51) Int. Cl.
*F01D 5/30* (2006.01)
*F01D 5/14* (2006.01)

(52) U.S. Cl.
CPC ..... *F01D 5/3007* (2013.01); *F01D 5/14* (2013.01); *F01D 5/30* (2013.01); *F05D 2260/36* (2013.01)

(58) Field of Classification Search
CPC ..... F01D 5/3007; F01D 5/30; F05D 2260/36
See application file for complete search history.

(56) References Cited

U.S. PATENT DOCUMENTS 1,793,468 A * 2/1931 Densmore ..... F01D 5/3007 416/219 R
5,147,180 A 9/1992 Johnson
(Continued)

FOREIGN PATENT DOCUMENTS

CN 1046206 A 10/1990
CN 1352725 A 6/2002
(Continued)

OTHER PUBLICATIONS

PCT International Search Report and Written Opinion dated Mar. 3, 2016 corresponding to PCT Application PCT/US2015/033636 filed Jun. 2, 2015.

*Primary Examiner* — Nathaniel E Wiehe
*Assistant Examiner* — Jackson N Gillenwaters

(57) ABSTRACT

An attachment system (10) for a turbine airfoil (12) including one or more roots (14) to attach the turbine airfoil (12) to a rotor, whereby the roots (14) have one or more curved teeth (18) that substantially limit, if not completely eliminate, circumferential rocking motion of the turbine airfoil (12) relative to a disc (20) supporting the turbine airfoil (12) during turning gear operation. The curved configuration of the teeth (18) extending laterally from the root (14) prevent rotation of the turbine airfoil (12) relative to the disc (20) supporting the turbine airfoil (12), thereby preventing premature failure of the turbine airfoil (12) or disc (20) due to wear from turbine airfoil (12) rocking during turning gear operation. In at least one embodiment, a laterally extending outer edge (22) of an axially extending tooth (18) may be curved about an axis (30) orthogonal to a centerline (26) of a turbine engine (28) in which the turbine airfoil (12) is positioned.

11 Claims, 7 Drawing Sheets

(56) References Cited

U.S. PATENT DOCUMENTS

| | | | | |
|---|---|---|---|---|
| 5,176,500 | A | 1/1993 | Heinig | |
| 5,480,285 | A | 1/1996 | Patel et al. | |
| 6,682,306 | B2 * | 1/2004 | Murakami | F01D 5/141 416/189 |
| 6,755,986 | B2 * | 6/2004 | Anding | F01D 5/081 416/244 A |
| 7,300,253 | B2 * | 11/2007 | Beeck | F01D 5/3007 416/193 A |
| 8,292,583 | B2 | 10/2012 | Marra | |
| 8,979,498 | B2 | 3/2015 | Mazzola et al. | |
| 9,739,159 | B2 * | 8/2017 | Carter | F01D 5/147 |
| 2005/0175462 | A1 | 8/2005 | Lagrange et al. | |
| 2010/0166561 | A1 * | 7/2010 | Boyer | F01D 5/3007 416/219 R |
| 2018/0363479 | A1 * | 12/2018 | Kittleson | F01D 5/3007 |

FOREIGN PATENT DOCUMENTS

| | | | |
|---|---|---|---|
| EP | 0291725 | A1 | 11/1988 |
| GB | 2030657 | A | 4/1980 |
| JP | S5939905 | A | 3/1984 |
| JP | H04259601 | A | 9/1992 |
| JP | 2008095667 | A | 4/2008 |

* cited by examiner

ATTACHMENT SYSTEM FOR A TURBINE AIRFOIL USABLE IN A GAS TURBINE ENGINE

FIELD OF THE INVENTION

This invention is directed generally to airfoils usable in turbine engines, and more particularly to airfoil attachment systems.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies, to these high temperatures. As a result, turbine airfoils, such as turbine vanes and blades must be made of materials capable of withstanding such high temperatures.

The airfoils are typically attached to a rotor assembly via a root contained within a disc. There typically exists a small gap between the bottom of the teeth of the root and corresponding surfaces of the disc that enable the airfoil root to be inserted into the disc cavity. At times, a typical turbine engine operates on a turning gear after shutdown from load conditions. The turning gears, which are typically AC electric motors with gear mechanisms, keep the shaft turning slowly at several RPM while the axial compressor rotor is cooling. During turning gear operation, conventional root configurations with linear teeth, as shown in FIGS. 1 and 2, extending from the root permit circumferential movement of the turbine airfoil relative to the disc support. As such, the turbine airfoil is able to flop back and forth in the circumferential direction relative to the disc supporting the airfoil when the turbine airfoil pass top dead center. Because of the weight of the large gas turbine airfoils, such movement of the turbine airfoil relative to the disc support causes wear to the teeth on the root and to the disc resulting in the need to replace the airfoil prematurely. Thus, there exists a need to reduce the damage caused by the turbine airfoil moving during operation relative to the disc.

SUMMARY OF THE INVENTION

An attachment system for a turbine airfoil including one or more roots to attach the turbine airfoil to a rotor, whereby the roots have one or more curved teeth that substantially limit, if not completely eliminate, circumferential rocking motion of the turbine airfoil relative to a disc supporting the turbine airfoil during turning gear operation. The curved configuration of the teeth extending laterally from the root prevent rotation of the turbine airfoil relative to the disc supporting the turbine airfoil, thereby preventing premature failure of the turbine airfoil or disc due to wear from turbine airfoil rocking during turning gear operation. In at least one embodiment, a laterally extending outer edge of an axially extending tooth may be curved about an axis orthogonal to a centerline of a turbine engine in which the turbine airfoil is positioned.

In at least one embodiment, an attachment system for a turbine airfoil of a turbine engine may include one or more roots configured to support a turbine airfoil within a turbine engine. The root may include a first side first axially extending tooth extending from a first side of the at least one root. A radially outer bearing surface of the first side first axially extending tooth may extend at a first acute angle inwardly relative to a radially extending longitudinal axis of the root. A laterally extending outer edge of the first side first axially extending tooth may extend generally along an axis aligned with a centerline of the turbine engine curved about the axis such that the curved laterally extending outer edge is viewed orthogonally to the centerline of the turbine engine, radially outward of the turbine airfoil looking into the centerline of the turbine engine. The curved laterally extending outer edge of the first side first axially extending tooth substantially may reduce circumferential motion of the turbine airfoil attached to the root relative to a supporting disc.

The curved laterally extending outer edge of the first side first axially extending tooth may be configured such that circumferential motion of the turbine airfoil attached to the root relative to a supporting disc is prohibited. A straight line distance measured in a direction orthogonal to the centerline of the turbine engine between an upstream end of the curved laterally extending outer edge of the first side first axially extending tooth and a lateral high point of the curved laterally extending outer edge may be greater than a tooth clearance dimension measured between the first side first axially extending tooth and the supporting disc to prevent circumferential rocking or movement of the turbine airfoil. The tooth clearance dimension measured between the first side first axially extending tooth and the supporting disc may be measured between a radially inward surface of the first side first axially extending tooth and a closest surface of the supporting disc.

The attachment system may include one or more second side first axially extending teeth extending from a second side of the at least one root. A radially outer bearing surface of the second side first axially extending tooth may extend at a first acute angle inwardly relative to a radially extending longitudinal axis of the root. A laterally extending outer edge of the second side first axially extending tooth that extends generally along an axis aligned with the centerline of the turbine engine may be curved about the axis such that the curved laterally extending outer edge is viewed orthogonally to the centerline of the turbine engine, radially outward of the turbine airfoil looking into the centerline of the turbine engine. The curved laterally extending outer edge of the second side first axially extending tooth substantially may reduce circumferential motion of the turbine airfoil attached to the root relative to a supporting disc. A radius of curvature of the laterally extending outer edge of the second side first axially extending tooth may be generally equal to a radius of curvature of the laterally extending outer edge of the first side first axially extending tooth. The curved laterally extending outer edge of the first side first axially extending tooth may be configured such that circumferential motion of the turbine airfoil attached to the root relative to a supporting disc is prohibited.

A straight line distance measured in a direction orthogonal to the centerline of the turbine engine between an upstream end of the curved laterally extending outer edge of the first side first axially extending tooth and a lateral high point of the curved laterally extending outer edge may be greater than a tooth clearance dimension measured between the first side first axially extending tooth and the supporting disc. The tooth clearance dimension measured between the first side first axially extending tooth and the supporting disc may be measured between a radially inward surface the first side first axially extending tooth and a closest surface of the supporting disc.

In at least one embodiment, the attachment system may include a plurality of first side axially extending teeth extending from the first side of the at least one root. The plurality of first side axially extending teeth extending from the first side of the root comprise the first side first axially extending tooth extending from the first side of the root and one or more first side second axially extending teeth extending from the first side of the root. A laterally extending outer edge of the first side second axially extending tooth that extends generally along the axis aligned with the centerline of the turbine engine may be curved about the axis such that the curved laterally extending outer edge is viewed orthogonally to the centerline of the turbine engine, radially outward of the turbine airfoil looking into the centerline of the turbine engine, whereby the curved laterally extending outer edge of the first side second axially extending tooth substantially reduces circumferential motion of the turbine airfoil attached to the root relative to a supporting disc. The attachment system may also include a plurality of second side axially extending teeth extending from the second side of the root. The plurality of second side axially extending teeth extending from the second side of the root comprise the second side first axially extending tooth extending from the second side of the root and one or more second side second axially extending teeth extending from the second side of the root, wherein a laterally extending outer edge of the second side second axially extending tooth that extends generally along the axis aligned with the centerline of the turbine engine is curved about the axis such that the curved laterally extending outer edge is viewed orthogonally to the centerline of the turbine engine, radially outward of the turbine airfoil looking into the centerline of the turbine engine, whereby the curved laterally extending outer edge of the second side second axially extending tooth substantially reduces circumferential motion of the turbine airfoil attached to the at least one root relative to a supporting disc.

The attachment system may include a supporting disc with one or more first side first axially extending tooth recesses that are curved and configured to receive the first side first axially extending tooth. The first side first axially extending tooth recess of the supporting disc may have a centerline that is curved with an equal radius of curvature to the curved laterally extending outer edge of the first side first axially extending tooth. The supporting disc may include one or more second side first axially extending tooth recesses that are curved and configured to receive the second side first axially extending tooth.

During use, the tooth clearance dimension enables the curved teeth to be inserted into the first and second side first axially extending tooth recesses because the first and second side first axially extending tooth recesses are slightly larger than the first and second side curved teeth. However, during use in turning gear operation, when the rotor is rotating at about two revolutions per minute, the configuration of the attachment system with curved teeth extending from the root and contained within the first and second side first axially extending tooth recesses prevent any movement of the turbine airfoil in the circumferential direction even though the tooth clearance dimension exists. In particular, the radially inwardmost edges of the curved teeth on the laterally extending outer edges and the upper edge of curved teeth on an opposite side of the root from the radially inwardmost edges prevent the root from rotating within the disc. Thus, the attachment system retains the turbine airfoil within the disc and prevents the turbine airfoil from flopping from one side to the other during turning gear operation, thereby preventing wear damage from occurring on the root of the turbine airfoil or the supporting disc.

An advantage of the attachment system is that the attachment system retains the turbine airfoil within the disc and prevents the turbine airfoil from flopping from one side to the other during turning gear operation, thereby preventing wear damage from occurring on the root of the turbine airfoil or the supporting disc.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
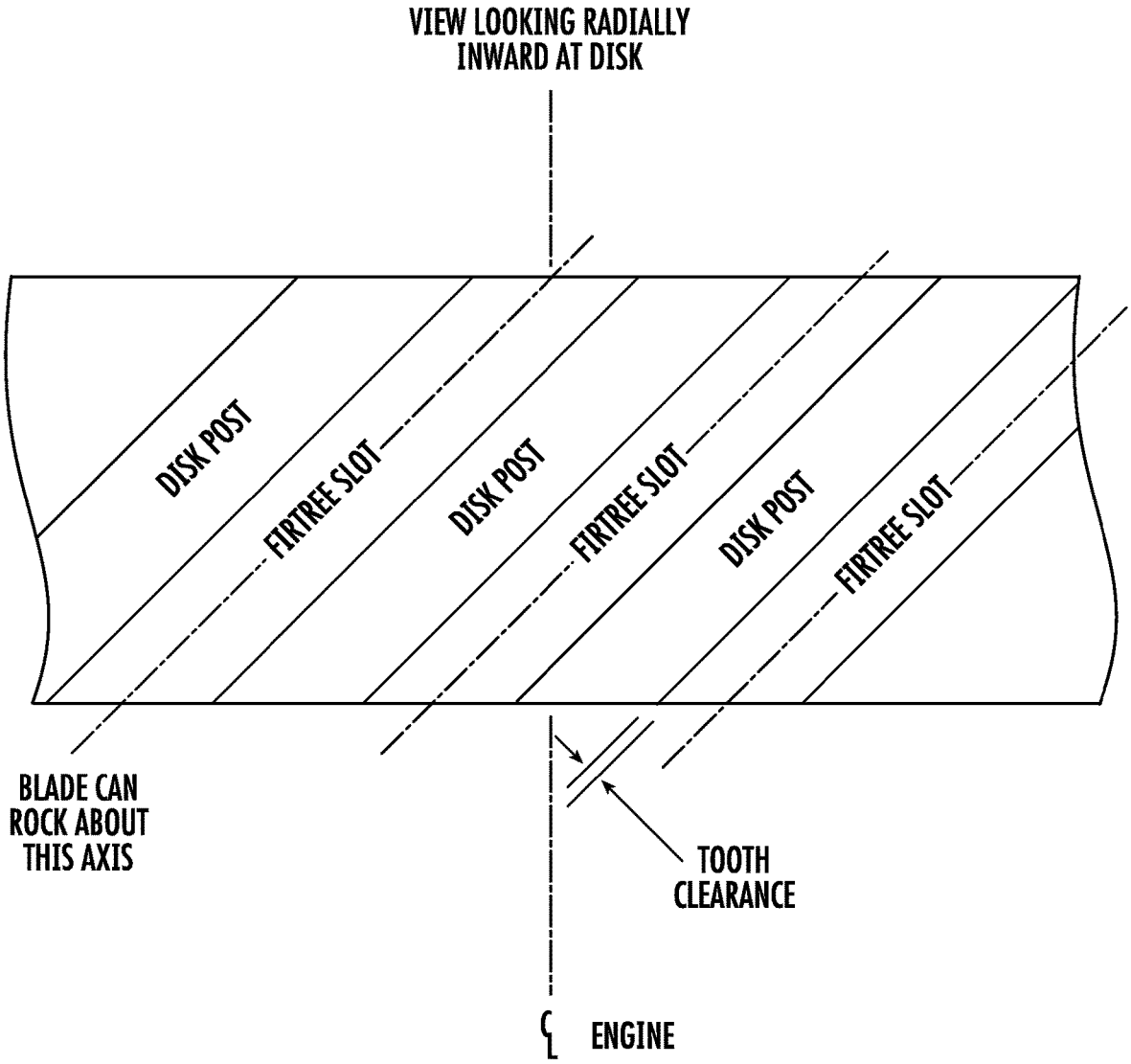
FIG. 1 (PRIOR ART)
FIG. 1 is a top view of a rotor usable in a turbine engine for supporting a circumferentially extending row of airfoils in which the conventional root slots are linear.
Figure 2:
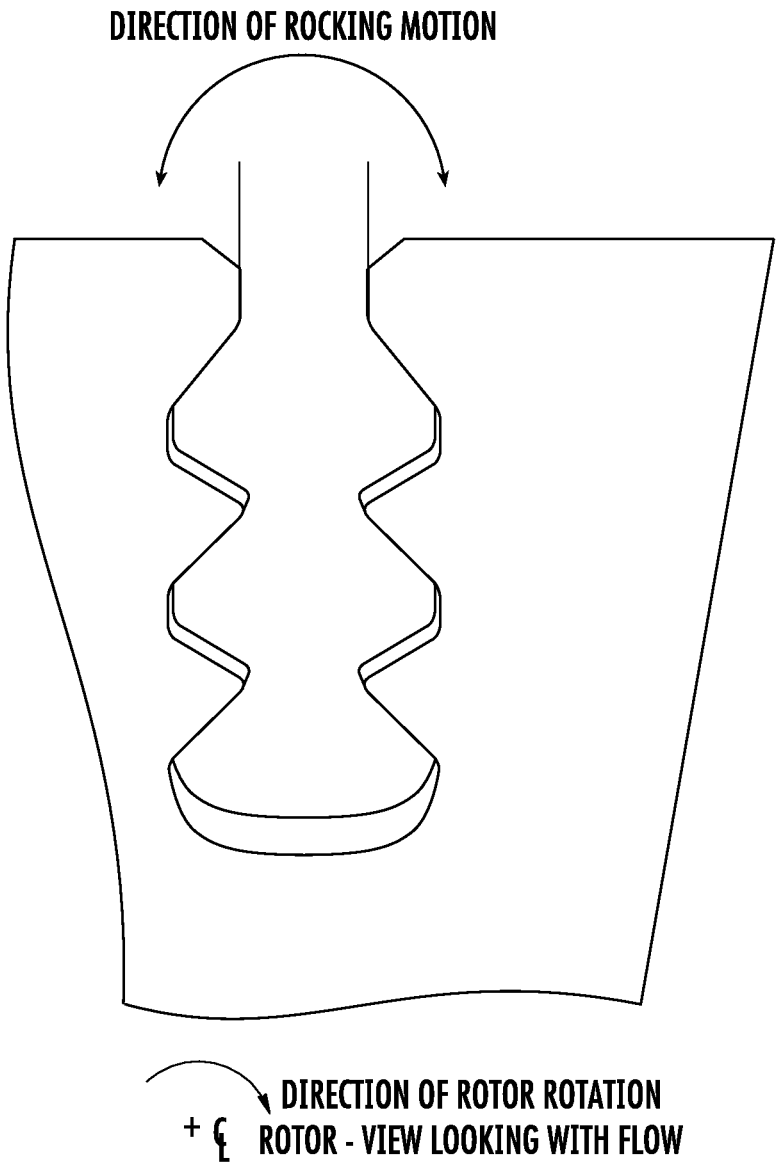
FIG. 2 (PRIOR ART)
FIG. 2 is an end view of a conventional root of a turbine airfoil positioned within a root slot.
Figure 3:
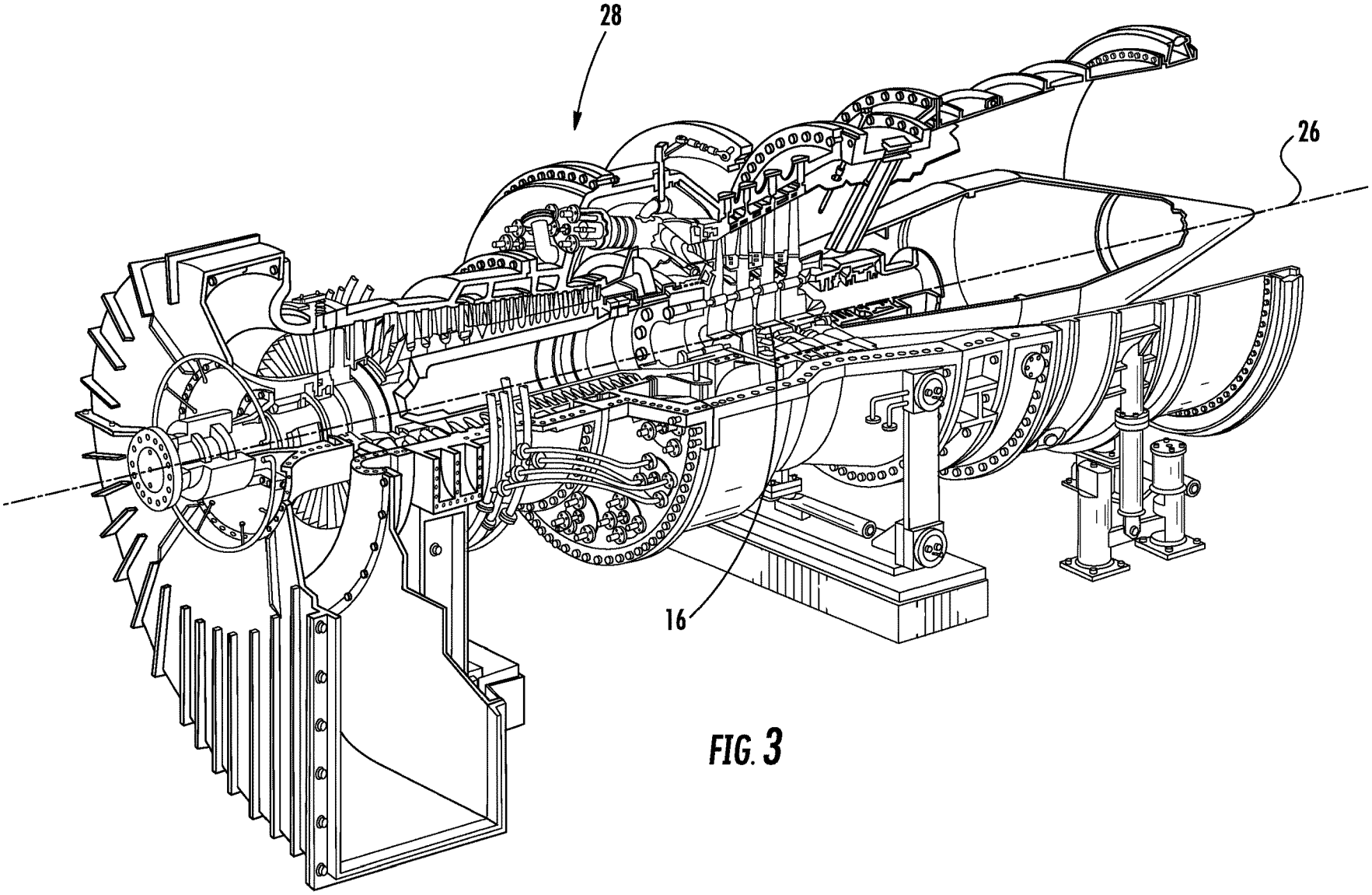
FIG. 3 is a partial cross-sectional view of a gas turbine engine in which one or more airfoils are attached to a disc via an attachment system with curved teeth extending from a root.
Figure 4:
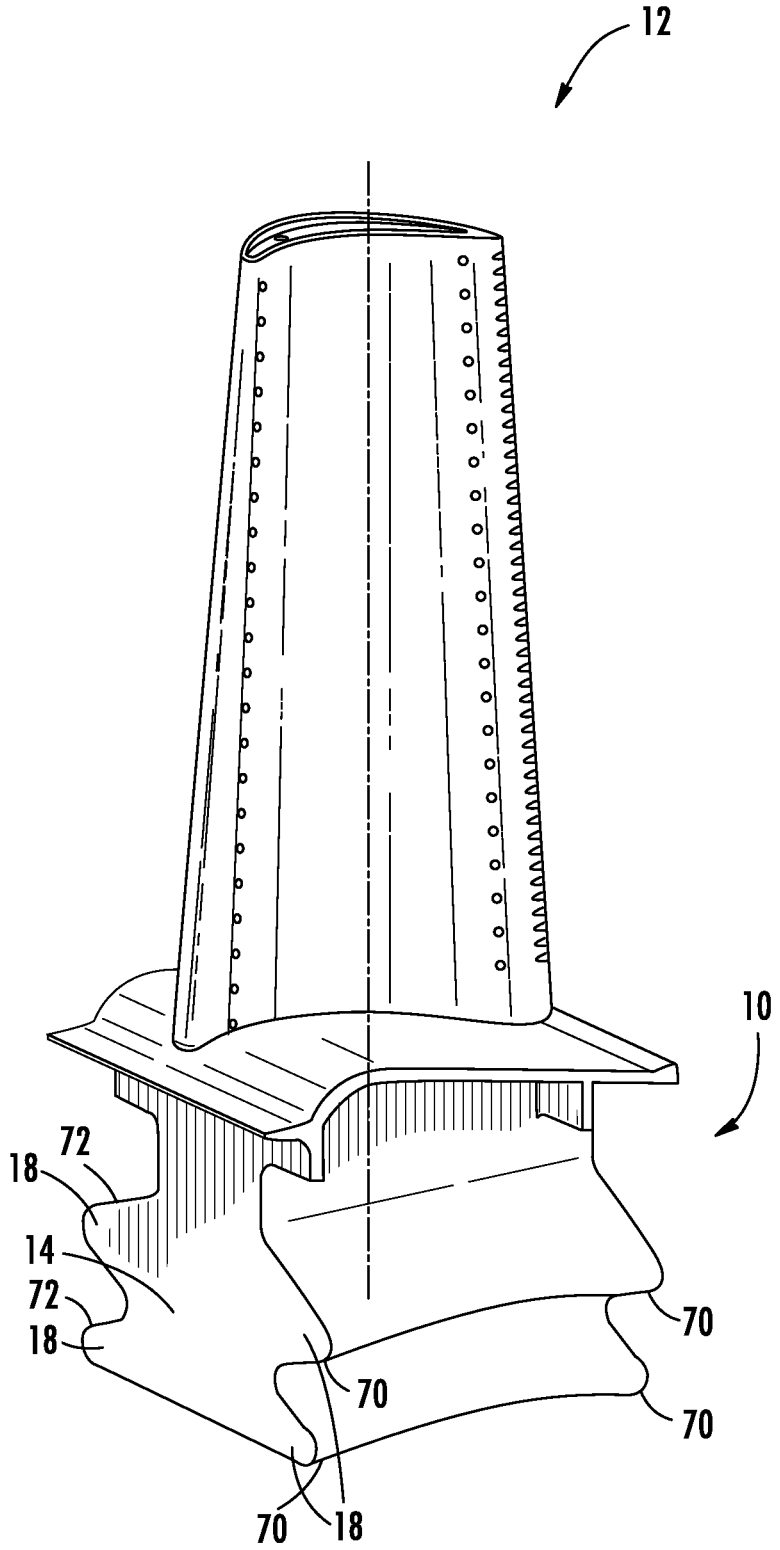
FIG. 4 is a perspective view of a turbine blade of a gas turbine engine with the attachment system having curved teeth extending from a root.
Figure 5:
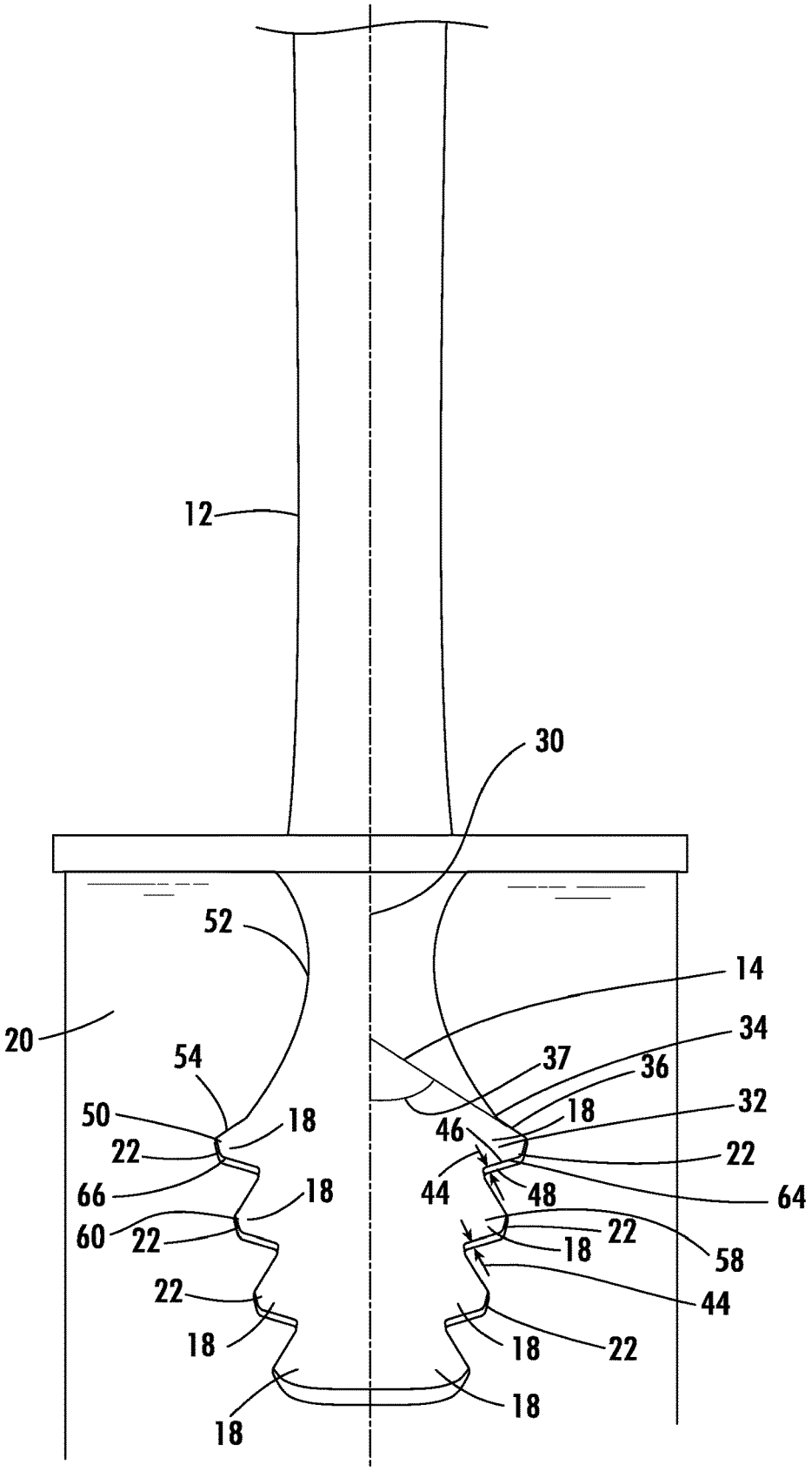
FIG. 5 is an end view of the turbine blade of FIG. 4.
Figure 6:
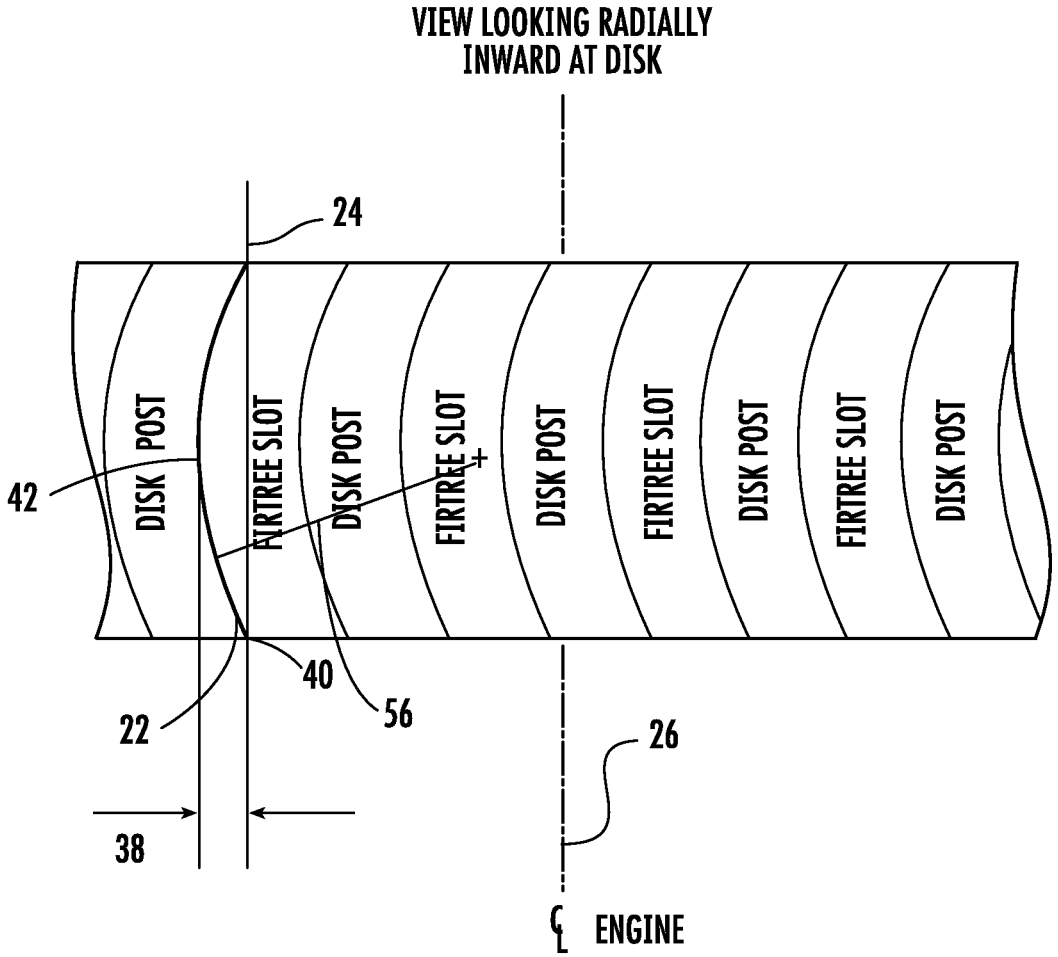
FIG. 6 is a top view of a rotor usable in a turbine engine for supporting a circumferentially extending row of airfoils in which the curved teeth root extending from the turbine airfoil roots correspond to curved recesses within the disk slots.
Figure 7:
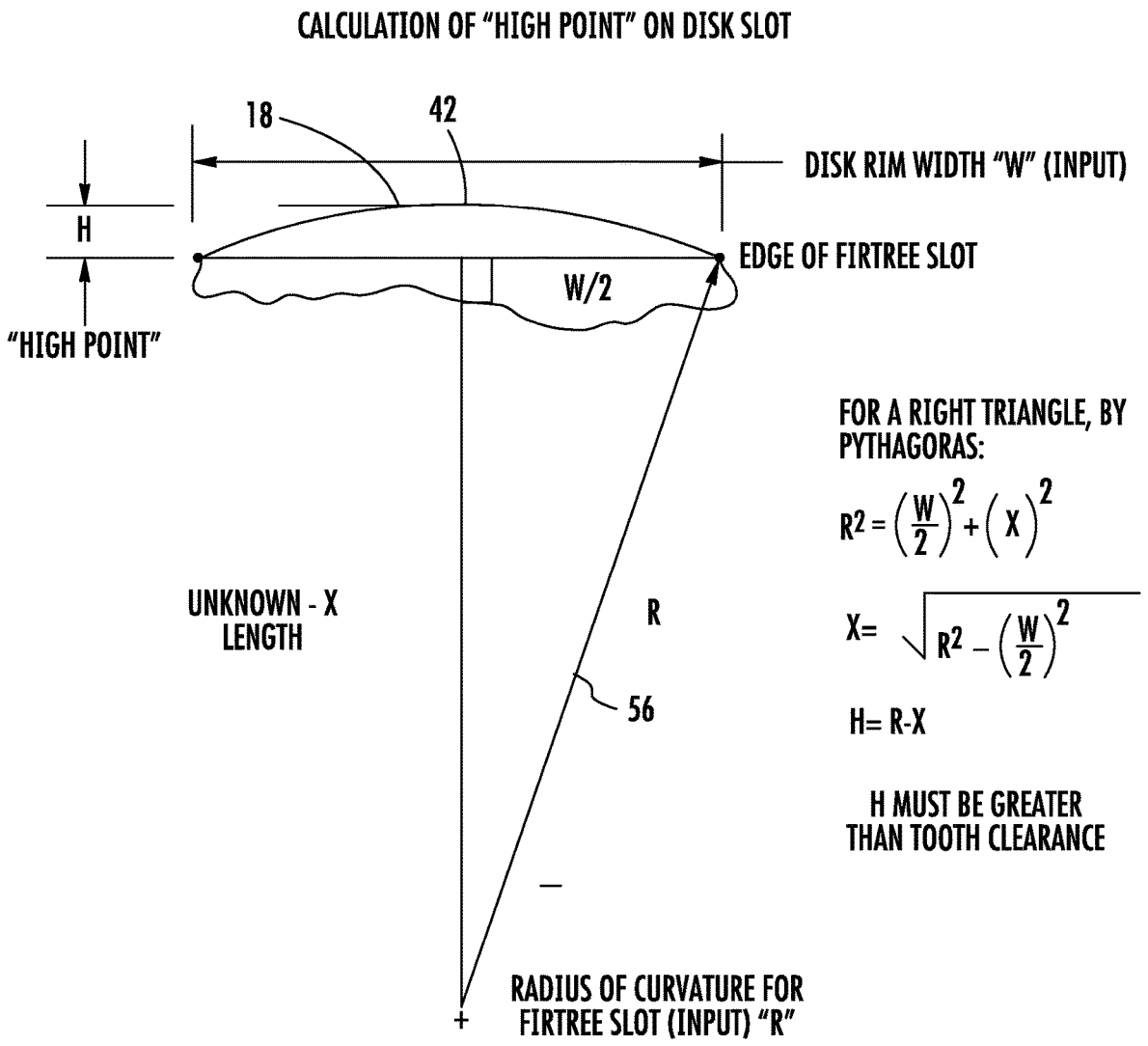
FIG. 7 is a schematic diagram of a portion of a curved tooth extending from a root of turbine airfoil.

As shown in FIGS. 3-7, an attachment system 10 for a turbine airfoil 12 including one or more roots 14 to attach the turbine airfoil 12 to a rotor 16, whereby the roots 14 have one or more curved teeth 18 that substantially limit, if not completely eliminate, circumferential rocking motion of the turbine airfoil 12 relative to a disc supporting the turbine airfoil 12 during turning gear operation. The curved configuration of the teeth 18, as shown in FIGS. 4, 6 and 7, extending laterally from the root 14 prevent rotation of the turbine airfoil 12 relative to the disc 20 supporting the turbine airfoil 12, thereby preventing premature failure of the turbine airfoil 12 or disc due to wear from turbine airfoil 12 rocking during turning gear operation. In at least one embodiment, a laterally extending outer edge 22 of an axially extending tooth 18 may be curved about an axis 24 orthogonal to a centerline 26 of a turbine engine 28 in which the turbine airfoil 12 is positioned.

In at least one embodiment, the attachment system 10 may include one or more roots 14 configured to support a turbine airfoil 12 within a turbine engine 28. The root 14 may include a first side first axially extending tooth 32 extending from a first side 34 of the root 14. A radially outer bearing surface 36 of the first side first axially extending tooth 32 may extend at a first acute angle 37 inwardly relative to a radially extending longitudinal axis 30 of the root 14. A laterally extending outer edge 22 of the first side first axially extending tooth 32 that extends generally along the axis 24 aligned with the centerline 26 of the turbine engine 28 is curved about the axis 30 such that the curved laterally extending outer edge 22 is viewed orthogonally to the centerline 26 of the turbine engine 28, radially outward of the turbine airfoil 12 looking into the centerline 26 of the turbine engine 28, whereby the curved laterally extending outer edge 22 of the first side first axially extending tooth 32 substantially reduces circumferential motion of the turbine airfoil 12 attached to the root 14 relative to a supporting disc 20. In at least one embodiment, the curved laterally extending outer edge 22 of the first side first axially extending tooth 32 may be configured such that circumferential motion of the turbine airfoil 12 attached to the root 14 relative to a supporting disc 20 is prohibited.

In at least one embodiment, a straight line distance 38 measured in a direction orthogonal to the centerline 26 of the turbine engine 28 between an upstream end 40 of the curved laterally extending outer edge 22 of the first side first axially extending tooth 32 and a lateral high point 42 of the curved laterally extending outer edge 22, as shown in FIGS. 6 and 7, may be greater than a tooth clearance dimension 44 measured between the first side first axially extending tooth 32 and the supporting disc 20. The tooth clearance dimension 44 measured between the first side first axially extending tooth 32 and the supporting disc 20, as shown in FIG. 5, may be measured between a radially inward surface 46 of the first side first axially extending tooth 32 and a closest surface 48 of the supporting disc 20. In at least one embodiment, the tooth clearance dimension 44 may be between about 0.01 mm and about 1 mm. In at least one embodiment, the tooth clearance dimension 44 may be about 0.1 mm.

The attachment system 10 may also include one or more second side first axially extending teeth 50 extending from a second side 52 of the root 14. A radially outer bearing surface 54 of the second side first axially extending tooth 50 extends at a first acute angle 37 inwardly relative to a radially extending longitudinal axis 30 of the root 14. The laterally extending outer edge 22 of the second side first axially extending tooth 32 that extends generally along an axis 24 aligned with the centerline 26 of the turbine engine 28 may be curved about the axis 30 such that the curved laterally extending outer edge 22 is viewed orthogonally to the centerline 26 of the turbine engine 28, radially outward of the turbine airfoil 28 looking into the centerline 26 of the turbine engine 28, whereby the curved laterally extending outer edge 22 of the second side first axially extending tooth 50 substantially reduces circumferential motion of the turbine airfoil 12 attached to the root 14 relative to a supporting disc 20. A radius of curvature 56 of the laterally extending outer edge 22 of the second side first axially extending tooth 50 may be generally equal to a radius of curvature 56 of the laterally extending outer edge 22 of the first side first axially extending tooth 32.

The curved laterally extending outer edge 22 of the second side first axially extending tooth 50 may be configured such that circumferential motion of the turbine airfoil 12 attached to the root 14 relative to a supporting disc 20 is prohibited. The second side first axially extending tooth 50 may be configured such that a straight line distance 38 measured in a direction orthogonal to the centerline 26 of the turbine engine 28 between an upstream end 40 of the curved laterally extending outer edge 22 of the second side first axially extending tooth 50 and a lateral high point 42 of the curved laterally extending outer edge 22 is greater than a tooth clearance dimension 44 measured between the second side first axially extending tooth 50 and the supporting disc 20. The tooth clearance dimension 44 measured between the second side first axially extending tooth 50 and the supporting disc 20 may be measured between a radially inward surface 46 the second side first axially extending tooth 50 and a closest surface 48 of the supporting disc 20.

In at least one embodiment, the attachment system 10 may include a plurality of first side axially extending teeth 32 extending from the first side 34 of the root 16. The plurality of first side axially extending teeth 32 extending from the first side 34 of the root 16 may include the first side first axially extending tooth 32 extending from the first side 34 of the root 14 and one or more first side second axially extending teeth 58 extending from the first side 34 of the root 14, wherein a laterally extending outer edge 22 of the first side second axially extending tooth 58 that extends generally along the axis 24 aligned with the centerline 26 of the turbine engine 28 is curved about the axis 30 such that the curved laterally extending outer edge 22 is viewed orthogonally to the centerline 26 of the turbine engine 28, radially outward of the turbine airfoil 12 looking into the centerline 26 of the turbine engine 28, whereby the curved laterally extending outer edge 22 of the first side second axially extending tooth 58 substantially reduces circumferential motion of the turbine airfoil 12 attached to the root 14 relative to a supporting disc 20.

The attachment system 10 may also include a plurality of second side axially extending teeth 50 extending from the second side 52 of the root 14. The plurality of second side axially extending teeth 50 extending from the second side 52 of the root 14 may include the second side first axially extending tooth 50 extending from the second side 52 of the root 14 and one or more second side second axially extending teeth 60 extending from the second side 52 of the root 14, wherein a laterally extending outer edge 22 of the second side second axially extending tooth 60 that extends generally along the axis 24 aligned with the centerline 26 of the turbine engine 28 is curved about the axis 30 such that the curved laterally extending outer edge 22 is viewed orthogonally to the centerline 26 of the turbine engine 28, radially outward of the turbine airfoil 12 looking into the centerline 26 of the turbine engine 28, whereby the curved laterally extending outer edge 22 of the second side second axially extending tooth 60 substantially reduces circumferential motion of the turbine airfoil 12 attached to the root 14 relative to a supporting disc 20.

The attachment system 10 may also be configured such that the supporting disc 20 includes one or more first side first axially extending tooth recesses 64 that is curved and configured to receive the first side first axially extending tooth 32.

The first side first axially extending tooth recess 64 of the supporting disc 20 may have a centerline that is curved with an equal radius of curvature to the curved laterally extending outer edge 22 of the first side first axially extending tooth 32. The attachment system 10 may include as many first axially extending tooth recesses 64 as there are first side first axially extending teeth 32 on the first side 34 of the root 14. The supporting disc 50 may include one or more second side first axially extending tooth recesses 66 that is curved and configured to receive the second side first axially extending tooth 50. The second side first axially extending tooth recesses 66 may be configured in the same manner as the first axially extending tooth recesses 64 such that each of the second side first axially extending tooth recesses 66 may be curved to receive a second side first axially extending tooth 50. The attachment system 10 may include as many first axially extending tooth recesses 64 as there are first side first axially extending teeth 32 on the first side 34 of the root 14.

During use, the tooth clearance dimension 44 enables the curved teeth 18 to be inserted into the first and second side first axially extending tooth recesses 64, 66 because the first and second side first axially extending tooth recesses 64, 66 are slightly larger than the first and second side curved teeth 18. However, during use in turning gear operation, when the rotor 16 is rotating at about two revolutions per minute, the configuration of the attachment system 10 with curved teeth 18 extending from the root 14 and contained within the first and second side first axially extending tooth recesses 64, 66 prevent any movement of the turbine airfoil 12 in the circumferential direction even though the tooth clearance dimension 44 exists. In particular, as shown in FIG. 4, the radially inwardmost edges 70 of the curved teeth 18 on the laterally extending outer edges 22 and the upper edge 72 of curved teeth 18 on an opposite side of the root 14 from the radially inwardmost edges 70 prevent the root 14 from rotating within the disc 20. Thus, the attachment system 10 retains the turbine airfoil 12 within the disc 20 and prevents the turbine airfoil 12 from flopping from one side to the other during turning gear operation, thereby preventing wear damage from occurring on the root 14 of the turbine airfoil 12 or the supporting disc 20.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. An attachment system for a turbine airfoil of a turbine engine, comprising:

at least one root configured to support a turbine airfoil within a turbine engine;

wherein the at least one root includes a first side first axially extending tooth extending from a first side of the at least one root;

wherein a radially outer bearing surface of the first side first axially extending tooth extends at a first acute angle inwardly relative to a radially extending longitudinal axis of the at least one root;

wherein a laterally extending outer edge of the first side first axially extending tooth that extends generally along an axis aligned with a centerline of the turbine engine is curved about the radially extending longitudinal axis such that the curved laterally extending outer edge is viewed orthogonally to the centerline of the turbine engine, radially outward of the turbine airfoil looking into the centerline of the turbine engine, whereby the curved laterally extending outer edge of the first side first axially extending tooth substantially reduces circumferential motion of the turbine airfoil attached to the at least one root relative to a supporting disc, wherein the curved laterally extending outer edge of the first side first axially extending tooth is configured such that circumferential motion of the turbine airfoil attached to the at least one root relative to a supporting disc is prohibited, wherein a straight line distance is measured in a direction orthogonal to the centerline of the turbine engine between an upstream end of the curved laterally extending outer edge of the first side first axially extending tooth and a lateral high point of the curved laterally extending outer edge, wherein a tooth clearance dimension is measured between a radially inward surface of the first side first axially extending tooth and a closest surface of the supporting disc, wherein the straight line distance is greater than the tooth clearance dimension, wherein the lateral high point of the curved laterally extending outer edge bisects a width of the curved laterally extending outer edge, and wherein the straight line distance H is calculated as follows:

$$H=R-\sqrt{R^2-(W/2)^2}$$

wherein: R is a radius of the curved laterally extending outer edge, and

W is the width of the curved laterally extending outer edge.

2. The attachment system for a turbine airfoil of a turbine engine of claim 1, further comprising at least one second side first axially extending tooth extending from a second side of the at least one root; wherein a radially outer bearing surface of the second side first axially extending tooth extends at a first acute angle inwardly relative to the radially extending longitudinal axis of the at least one root, wherein a laterally extending outer edge of the second side first axially extending tooth that extends generally along the axis aligned with the centerline of the turbine engine is curved about the radially extending longitudinal axis such that the curved laterally extending outer edge is viewed orthogonally to the centerline of the turbine engine, radially outward of the turbine airfoil looking into the centerline of the turbine engine, whereby the curved laterally extending outer edge of the second side first axially extending tooth substantially reduces circumferential motion of the turbine airfoil attached to the at least one root relative to a supporting disc.

3. The attachment system for a turbine airfoil of a turbine engine of claim 2, wherein a radius of curvature of the laterally extending outer edge of the second side first axially extending tooth is equal to a radius of curvature of the laterally extending outer edge of the first side first axially extending tooth.

4. The attachment system for a turbine airfoil of a turbine engine of claim 2, wherein the curved laterally extending outer edge of the first side first axially extending tooth is configured such that circumferential motion of the turbine airfoil attached to the at least one root relative to a supporting disc is prohibited.

5. The attachment system for a turbine airfoil of a turbine engine of claim 2, wherein a straight line distance is measured in a direction orthogonal to the centerline of the turbine engine between an upstream end of the curved laterally extending outer edge of the second side first axially extending tooth and a lateral high point of the curved laterally extending outer edge, wherein a tooth clearance dimension is measured between a radially inward surface the second side first axially extending tooth and a closest surface of the supporting disc, and wherein the straight line distance is greater than the tooth clearance dimension.

6. The attachment system for a turbine airfoil of a turbine engine of claim 2, further comprising a plurality of first side axially extending teeth extending from the first side of the at least one root.

7. The attachment system for a turbine airfoil of a turbine engine of claim 6, wherein the plurality of first side axially extending teeth extending from the first side of the at least one root comprise the at least one first side first axially extending tooth extending from the first side of the at least one root and at least one first side second axially extending tooth extending from the first side of the at least one root, wherein a laterally extending outer edge of the first side second axially extending tooth that extends generally along the axis aligned with the centerline of the turbine engine is curved about the radially extending longitudinal axis such that the curved laterally extending outer edge is viewed orthogonally to the centerline of the turbine engine, radially outward of the turbine airfoil looking into the centerline of the turbine engine, whereby the curved laterally extending outer edge of the first side second axially extending tooth substantially reduces circumferential motion of the turbine airfoil attached to the at least one root relative to a supporting disc.

8. The attachment system for a turbine airfoil of a turbine engine of claim 6, further comprising a plurality of second side axially extending teeth extending from the second side of the at least one root.

9. The attachment system for a turbine airfoil of a turbine engine of claim 8, wherein the plurality of second side axially extending teeth extending from the second side of the at least one root comprise the at least one second side first axially extending tooth extending from the second side of the at least one root and at least one second side second axially extending tooth extending from the second side of the at least one root, wherein a laterally extending outer edge of the second side second axially extending tooth that extends generally along the axis aligned with the centerline of the turbine engine is curved about the radially extending longitudinal axis such that the curved laterally extending outer edge is viewed orthogonally to the centerline of the turbine engine, radially outward of the turbine airfoil looking into the centerline of the turbine engine, whereby the curved laterally extending outer edge of the second side second axially extending tooth substantially reduces circumferential motion of the turbine airfoil attached to the at least one root relative to a supporting disc.

10. The attachment system for a turbine airfoil of a turbine engine of claim 1, wherein the supporting disc includes at least one first side first axially extending tooth recess that is curved and configured to receive the first side first axially extending tooth.

11. The attachment system for a turbine airfoil of a turbine engine of claim 10, wherein the at least one first side first axially extending tooth recess of the supporting disc has a centerline that is curved with an equal radius of curvature to the curved laterally extending outer edge of the first side first axially extending tooth.

* * * * *